United States Patent [19]

Akazawa

[11] Patent Number: 4,500,023

[45] Date of Patent: Feb. 19, 1985

[54] PAPER FEEDING APPARATUS FOR PRINTERS

[75] Inventor: Hiroyuki Akazawa, Shiojiri, Japan

[73] Assignees: Epson Corporation; Kabushiki Kaisha Suwa Seikosha, both of Tokyo, Japan

[21] Appl. No.: 409,269

[22] Filed: Aug. 18, 1982

[30] Foreign Application Priority Data

Aug. 20, 1981 [JP] Japan ..... 56-123806[U]

[51] Int. Cl.[3] ..... B65H 17/40; B41J 11/28; B41J 11/34; B41J 13/14

[52] U.S. Cl. ..... 226/76; 226/199; 400/616.3; 400/633

[58] Field of Search ..... 226/74, 75, 76, 79, 226/82, 83, 86, 196, 199; 400/633, 633.1, 633.2, 619, 613.1, 613.4, 616, 616.1, 616.2, 616.3

[56] References Cited

U.S. PATENT DOCUMENTS

| | | | |
|---|---|---|---|
| 928,877 | 7/1909 | McLaughlin | 400/633.2 |
| 1,503,069 | 7/1924 | Smith | 400/633.2 X |
| 1,697,433 | 1/1929 | Mitchell | 400/633.2 |
| 2,077,428 | 4/1937 | Mabon | 400/613.3 |
| 2,171,003 | 8/1939 | Mabon | 226/74 X |
| 2,226,151 | 12/1940 | Anderson | 400/633 X |
| 2,236,589 | 4/1941 | Anderson | 400/633.2 X |
| 2,286,084 | 6/1942 | Hageman | 226/75 |
| 2,313,888 | 3/1943 | Otis | 226/75 X |
| 2,627,333 | 2/1953 | Butler | 400/633 X |
| 2,630,901 | 3/1953 | Johnson et al. | 226/79 |
| 3,465,937 | 9/1969 | Grurer et al. | 226/76 |
| 3,693,856 | 9/1972 | Funk | 226/74 |
| 3,746,228 | 7/1973 | Arnold | 226/75 |
| 3,831,829 | 8/1974 | Karpisek | 226/83 |
| 4,189,078 | 2/1980 | Spisz | 400/616.1 X |
| 4,235,360 | 11/1980 | Levinson | 226/76 |

FOREIGN PATENT DOCUMENTS

| | | | |
|---|---|---|---|
| 170734 | 9/1951 | Austria | 226/86 |

*Primary Examiner*—Harvey C. Hornsby
*Assistant Examiner*—Scott J. Haugland
*Attorney, Agent, or Firm*—Blum, Kaplan, Friedman, Silberman & Beran

[57] ABSTRACT

A paper feeding apparatus for use in a printer is capable of feeding both continuous computer or fan-fold paper having holes in the peripheral edges thereof and single sheets of paper such as letter paper. The paper feeding apparatus includes a frame having a platen rotatably supported thereon and a guide shaft supported on the frame. First and second paper feeding members are disposed on the guide shaft and spaced apart for feeding a fan-fold paper along the peripheral edges thereof by means of the holes therealong. First and second guide members are disposed intermediate the first and second paper feeding members. The first and second paper guide members each have a first portion for guiding a continuous fan-fold paper fed by the first and second paper feeding members, a second portion for guiding a single sheet of paper while being inserted and fed into the printer and a third surface for guiding a single sheet of paper while it is being fed out of the printer, past the platen.

12 Claims, 6 Drawing Figures

FIG. 1
PRIOR ART
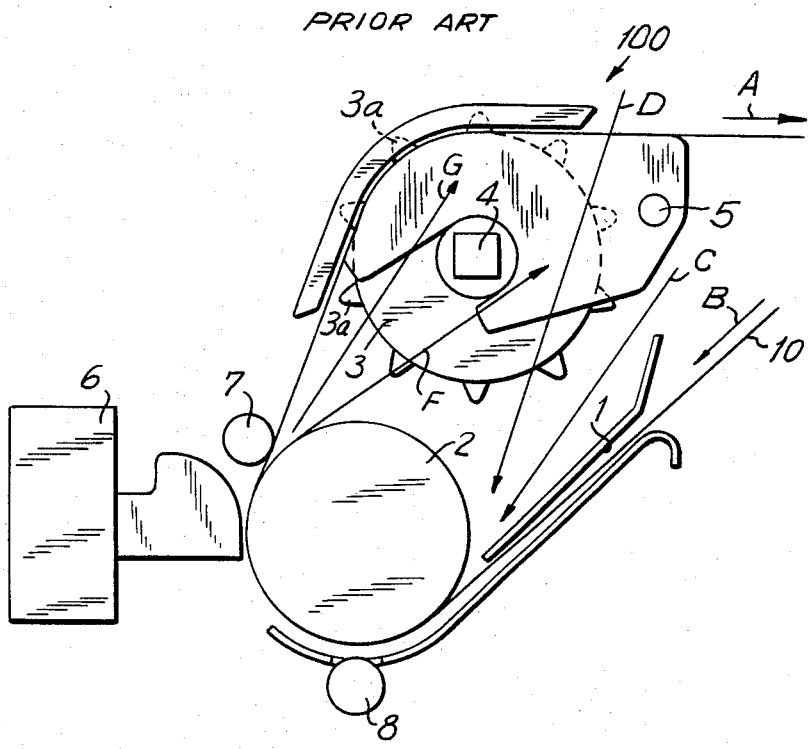
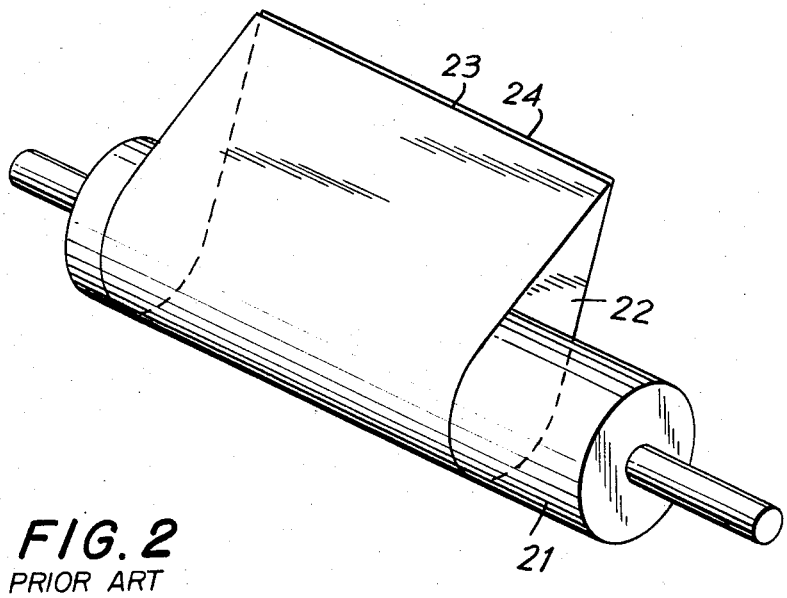
FIG. 2
PRIOR ART

FIG. 4
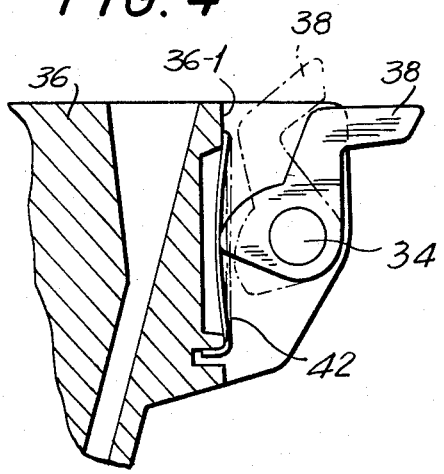
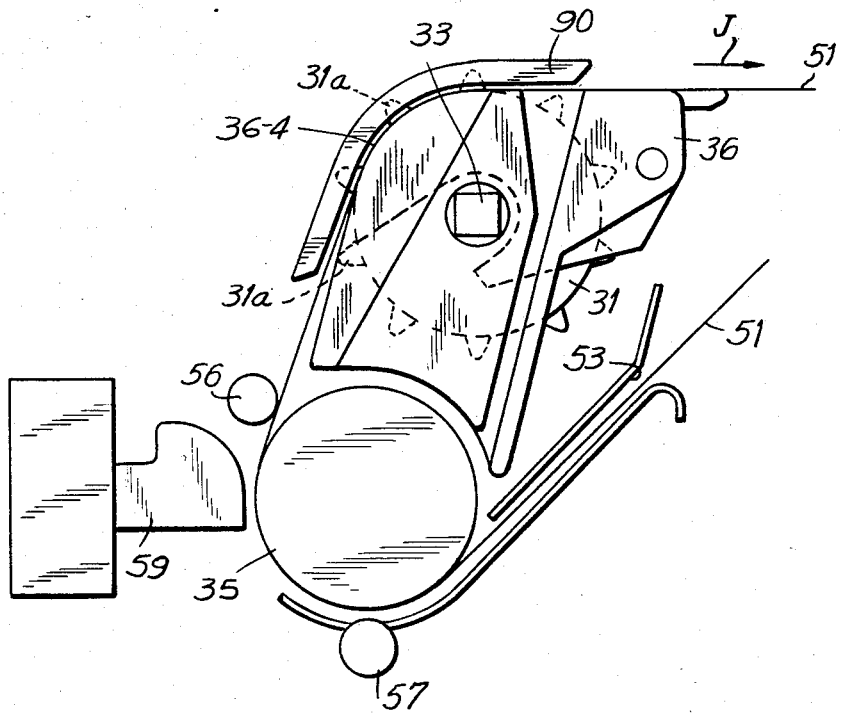
FIG. 5

PAPER FEEDING APPARATUS FOR PRINTERS

BACKGROUND OF THE INVENTION

The present invention is generally directed to a paper feeding apparatus for use in printers utilized in computers, word processing equipment and the like, and, in particular, to a paper feeding apparatus for a printer which can accurately feed both continuous computer or fan-fold paper and single paper sheets.

Terminal printers used for printing out data of computers have been utilized as output devices for word processing equipment. It is necessary that such printers print on both continuous computer or fan-fold paper which has holes along the peripheral edges thereof, as well as single sheets of paper such as letter paper and letterhead. Generally, single sheet letter paper is used less often by users than continuous computer or fan-fold paper. Hence, conventional paper feeding devices utilized in these printers are constructed so as to be convenient for feeding fan-fold paper and inconvenient for feeding single sheets of paper such as letter paper through the printer. Accordingly, a paper feeding apparatus for use in printers which, in addition to feeding continuous computer paper, can also accurately guide and feed single sheets of paper, is desired.

SUMMARY OF THE INVENTION

Generally speaking, in accordance with the present invention, a paper feeding apparatus for a use in a printer which can feed both a continuous paper having holes along the peripheral edges thereof and single sheets of paper, is provided. The paper feeding apparatus includes a frame which rotatably supports a platen. A guide shaft is also supported on the frame. First and second paper feeding members are disposed on the guide shaft above the platen and are spaced apart so that the peripheral edges of a continuous paper contact the first and second paper feeding members for feeding the continuous paper along the peripheral edges thereof.

First and second paper guide members are disposed on the guide shaft intermediate the first and second paper feeding members. The first and second guide members each include a first portion for guiding the continuous paper fed by the paper feeding members, a second portion for guiding a single sheet of paper while being fed into the printer and a third guide portion for guiding the single sheet while being fed out of the printer.

In a preferred embodiment, the paper guide members are slidably supported on the guide shaft so that the spacing therebetween can be adjusted to correspond to different widths of single sheets of paper. When slidably disposed on the guide shaft, each guide member will include a biased locking member for locking the first and second paper guide members in selected positions along the guide shaft.

Accordingly, it is an object of the present invention to provide an improved paper feeding apparatus for use in printers.

Another object of the present invention is to provide a paper feeding apparatus which can accurately feed both continuous computer or fan-fold paper and single sheets of paper.

Yet another object of the present invention is to provide a paper feeding device for use in printers which accurately guides single sheets of paper while being fed into the printer.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is partial side elevational view depicting various paper feeding paths in a conventional paper feeding apparatus in a printer;

FIG. 2 is a perspective view depicting the operation of adjusting a sheet of letter paper in a typewriter in order to insure that the top and bottom edges of the paper are parallel;

FIG. 4 is a sectional view of a locking member utilized in the paper guide members depicted in FIG. 3;

FIG. 5 is a sectional view of the paper feeding apparatus depicted in FIG. 3 in which a continuous computer or fan-fold paper is being fed.

DESCRIPTION OF THE PREFERRED EMBODIMENTS

Figure 3:
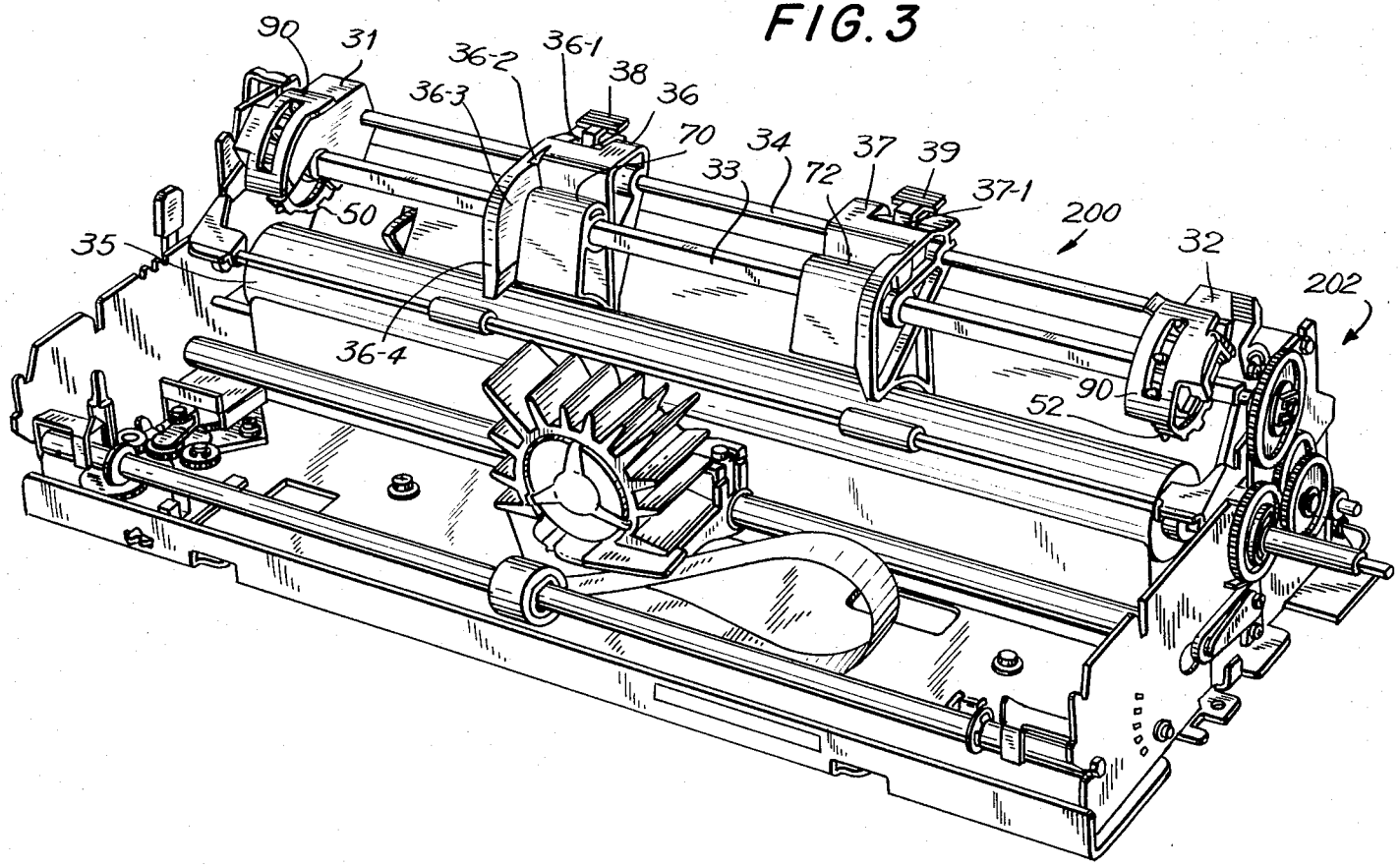
FIG. 3 is a perspective view of a printer which includes a paper feeding apparatus constructed in accordance with a preferred embodiment of the present invention.

Referring first to FIG. 1, the operation of feeding a continuous computer or fan-fold paper in a conventional paper feeding device in a printer will be described. A fan-fold paper 10 inserted at a paper entrance path 1 is wound around a platen 2 and is fed in the direction of arrow A as it is engaged with a sprocket wheel 3. Fan-fold paper 10 includes holes punched along the peripheral edges thereof which are engaged by projections 3*a* on sprocket 3 for feeding fan-fold paper along the edges thereof. A sprocket drive shaft 4 and a sprocket guide shaft 5 are supported by the printer frame.

A sprocket drive mechanism 100 is provided for the two side edges of fan-fold paper 10. Sprocket drive shaft 4 is rotated by a drive mechanism in order to rotate sprocket wheel 3 to thereby feed and advance paper 10 by means of the holes along the edges thereof. A printing head 6 is provided proximate platen 2 for printing on fan-fold paper 10.

Referring now to FIG. 2, the method of adjusting a sheet of letter paper in a typewriter so that the top and bottom ends thereof are parallel will be described. In straightening a single sheet of paper such as a letter paper 22, operaters of a typewriter generally align the top edge 23 and bottom edge 24 of paper 22 so that lines of print are properly printed on paper 22. Paper 22 is wound around a platen 21 and printing occurs with the paper against platen 21.

When a single sheet of paper such as letter paper 22 depicted in FIG. 2 is utilized in a printer with paper feeding device 100 depicted in FIG. 1, the entrance path may be one of three paths as shown by arrows B, C and D. The exit path may be either that shown by the arrow F or arrow G. In this case, if the paper is adjusted in the same way as described above with reference to FIG. 2, the operation of adjusting the paper onto the platen is disturbed by sprocket drive shaft 4 or sprocket guide shaft 5. Thus, the paper feeding device depicted in FIG. 1 is not convenient for feeding letter paper and, in fact, feeding letter paper proves difficult in such a device. When an operator is required to adjust the single sheet of letter paper each time it is fed by the conventional paper feeding device into the printer, needless time is wasted and inconvenience results.

Referring now to FIG. 3, a paper feeding device, generally indicated as 200, construced in accordance with the present invention shown incorporated into a printer, generally indicated at 202, is depicted. Paper feeding device 200 includes a platen 35, a drive shaft 33 and a guide shaft 34. Paper feeding members 31 and 32 are disposed at the ends of shafts 33 and 34 and include sprockets 50 and 52 which feed a continuous computer or fan-fold paper through printer 202 along the marginal edges thereof.

A pair of paper guide members 36 and 37 are slidably supported by shafts 33 and 34. Guide members 36 and 37 include lock members 38 and 39, respectively which are supported on guide shaft 34. Lock members 38 and 39 are received in U-shaped grooves 36-1 and 37-1 of paper guide members 36 and 37, respectively. Since paper guide members 36 and 37 are symetrically constructed, only the left paper guide member 36 will be described in detail hereinafter.

Referring now to FIG. 4, lock member 38 is shown in solid lines in its locked position and in phantom lines in its unlocked position. In its unlocked position, lock member 38 is not urged against a spring 42 disposed in U-shaped groove 36-1 of paper guide member 36. When lock member is in its unlocked position depicted in phantom in FIG. 4, guide member 36 is slidable along guide shaft 34. When lock member 38 is in its locked position depicted in FIG. 4, friction is produced between lock member 38 and guide shaft 34 by means of the force exerted on lock member 38 by means of spring 42. Under such friction, paper guide member 36 will be fixed at a given position on guide shaft 34.

Referring now to FIG. 5, the manner of feeding a fan-fold paper 51 will be described. Fan-fold paper 51 is inserted along a paper entrance path 53 and is wound around platen 35. Fan-fold paper 51 passes in front of printing head 59 and is engaged with teeth 31*a* disposed on the periphery of sprocket wheel 31. A guide plate 90 is provided for holding paper 51 against sprocket wheel 31. Fan-fold paper 51 is guided by the peripheral surface portion 36-4 of paper guide member 36 which is shaped so as to conform to the paper path. Surface 36-4 on guide member 36 acts to prevent fan-fold paper 51 from sagging between the pair of sprocket feed members 31 and 32 and also keeps tension on fan-fold paper 51. When fan-fold paper 51 is utilized, presser roller 56 and 57 are held in the position where they are disengaged from platen 35.

Figure 6:
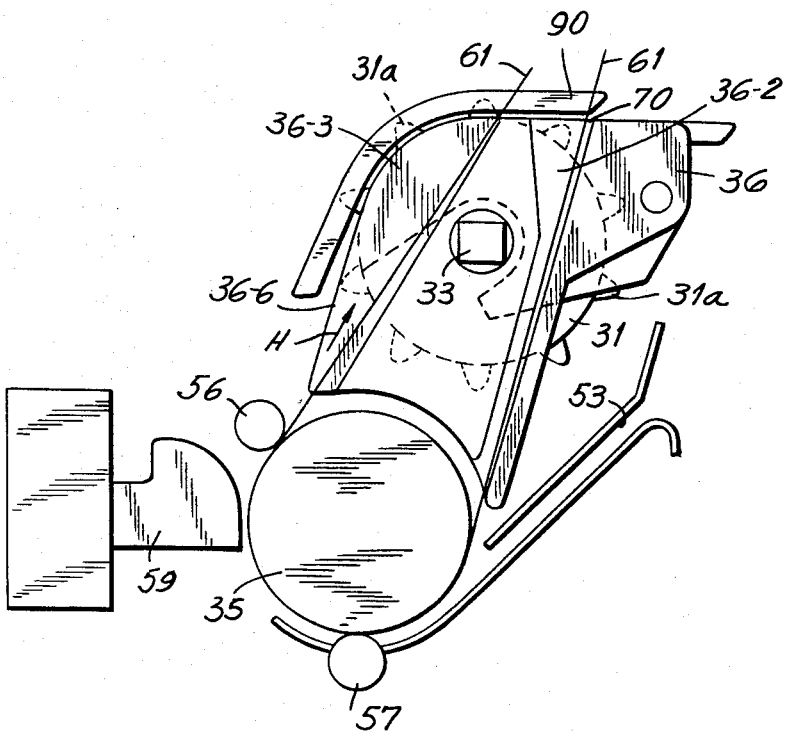
FIG. 6 is a sectional view of the paper feeding apparatus depicted in FIG. 3 in which a single sheet of letter paper is being fed.

Referring now to FIG. 6, the manner in which a single sheet of letter paper or the like is fed will be described. Single sheet paper 61 is inserted in paper entrance path 70 formed in paper guide member 36 and is wound around platen 35. Paper 61 then passes in front of printing head 59 as it is pressed by presser rollers 56 and 57 against platen 35. Paper 61 is fed in the direction of arrow H with the rotation of platen 35. During paper feeding, single sheet paper 61 is controlled by third guide portion or surface 36-6 of paper guide member 36 so that it is fed straight. In addition, the paper position in the direction of the paper width is determined by the shaded guidewalls in FIG. 6, depicted in FIG. 3 as 36-2 and 36-3.

If paper guide members 36 and 37 are adjusted so that the respective guidewalls thereof correspond to the width of sheet 61, sheet 61 will be controlled at the entrance and exit paths by the guidewalls and will be perfectly vertically positioned with respect to the length of platen 35. Thus, sheet 61 will be automatically adjusted so that its top and bottom edges are parallel. In other words, when a sheet of letter paper is utilized, it is unnecessary to manually adjust the paper as described above with reference to FIG. 2.

Several types of printing methods may be utilized such as impact-type printing utilizing wire dots or a daisy wheel or a non-impact type such as ink jet printing or thermal printing. It should be understood by those skilled in the art that various changes and modifications may be made, such as for example utilizing a tractor instead of sprocket wheels for the paper feeding members, without affecting the present invention.

As described above, if the paper feeding apparatus of the present invention is incorporated in a printer, the printer will be able to accurately print on both fan-fold or computer paper as well as single sheets of paper such as letter paper. The present invention improves the convenience of utilizing single sheets of letter paper as well as improving the feeding of fan-fold paper.

It will thus be seen that the object set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A paper feeding apparatus for use in a printer for feeding both a continuous paper having holes along the peripheral edges thereof and a single sheet of paper comprising a frame, platen means rotatably supported on said frame, a guide shaft supported on said frame, first and second paper feeding means disposed on said guide shaft above said platen means, said first and second paper feeding means being spaced apart so that the peripheral edges of a continuous paper can contact the first and second paper feeding means so that the continuous paper can be fed by the paper feeding means by utilizing the holes along the peripheral edges of the continuous paper, and first and second paper guides disposed on said guide shaft intermediate said first and second paper feeding means, said first and second paper guides having a first portion for guiding a continuous paper fed by the first and second paper feeding means, a second portion for guiding a single sheet of paper therethrough not fed by said first and second paper feeding means while being fed into said printer and a third guide portion for guiding the single sheet of paper therebetween after having traveled beyond said platen means.

2. The paper feeding apparatus as claimed in claim 1, wherein said first and second paper guides are slidably disposed on said shaft, said first and second paper guides including first and second locking means, respectively, for selectively locking said first and second paper guides at selected positions along said guide shaft for adjustment to the width of said single sheet of paper.

3. The paper feeding apparatus as claimed in claim 1 or 2, wherein said first and second paper feeding means include first and second sprocket wheels, respectively, for engaging the holes along the peripheral edges of a continuous paper.

4. The paper feeding apparatus as claimed in claims 1 or 2, wherein said second and third portions of said first and second paper guides cooperate to insure that a single sheet of paper is accurately fed through said printer.

5. The paper feeding apparatus as claimed in claim 4, wherein said platen means is cylindrical.

6. The paper feeding apparatus as claimed in claim 5, wherein said first and second paper feeding means include first and second sprocket wheels, respectively, for engaging the holes along the peripheral edges of a continuous paper.

7. The paper feeding apparatus as claimed in claim 4, wherein said first and second locking means include first and second biasing means, respectively, for biasing said locking means against said guide shaft.

8. The paper feeding apparatus as claimed in claim 7, wherein said first and second locking means are slidably disposed on said guide shaft.

9. The paper feeding apparatus as claimed in claim 8, wherein said first and second paper guides each include a U-shaped groove, said first and second locking means being respectively disposed in the U-shaped grooves of the first and second paper guides.

10. The paper feeding apparatus as claimed in claim 7, wherein said first and second biasing means are springs.

11. The paper feeding apparatus as claimed in claim 4, wherein said platen means includes pressing means for pressing a single sheet of paper against said platen means when fed in said printer.

12. The paper feeding apparatus as claimed in claim 2, wherein said first and second paper guides each include a U-shaped groove, said first and second locking means being respectively disposed in the U-shaped grooves of the first and second paper guides.

* * * * *